US005105744A

United States Patent [19]

Petrovich

[11] Patent Number: 5,105,744

[45] Date of Patent: Apr. 21, 1992

[54] JACKETED PROJECTILE FOR AMMUNITION

[76] Inventor: Paul A. Petrovich, 11269 Judd Rd., Fowlerville, Mich. 48836

[21] Appl. No.: 591,533

[22] Filed: Oct. 1, 1990

Related U.S. Application Data

[62] Division of Ser. No. 539,959, Jun. 18, 1990.

[51] Int. Cl.[5] ..... F42B 12/76

[52] U.S. Cl. ..... 102/515; 102/516; 102/518; 102/527

[58] Field of Search ..... 102/439, 501, 514–519, 102/527

[56] References Cited

U.S. PATENT DOCUMENTS

| | | | |
|---|---|---|---|
| 2,121,796 | 6/1938 | Helbich | 102/517 |
| 3,861,311 | 1/1975 | Bilsbury | 102/517 |
| 4,781,117 | 11/1988 | Garnett et al. | 102/493 |
| 4,958,571 | 9/1990 | Puckett | 102/522 |

FOREIGN PATENT DOCUMENTS

| | | | |
|---|---|---|---|
| 309293 | 1/1920 | Fed. Rep. of Germany | 102/517 |
| 2224925 | 1/1973 | Fed. Rep. of Germany | 102/515 |
| 2431676 | 3/1980 | France | 102/515 |
| 754 | 4/1889 | Switzerland | 102/517 |

*Primary Examiner*—Harold J. Tudor

*Attorney, Agent, or Firm*—Peter A. Taucher; David L. Kuhn

[57] ABSTRACT

The invention is a jacketed projectile for a round of ammunition wherein the jacket is deformed at least partially elastically when the projectile is driven through the barrel of a gun, the core of the projectile remaining undeformed.

10 Claims, 3 Drawing Sheets

JACKETED PROJECTILE FOR AMMUNITION

GOVERNMENT USE

The invention described herein may be manufactured, used and licensed by or for the United States Government for governmental purposes without payment to me of any royalty thereon.

This is a division of application Ser. No. 07/539,959 filed Jun. 18, 1990.

BACKGROUND AND SUMMARY

This application relates to bullets or projectiles that are part of ammunition cartridges typically used for rapid fire guns mounted on military vehicles such armored personnel carriers or the U.S. Army's High Mobility Multipurpose Vehicle (HMMV). The design for a projectile disclosed herein could also be adapted to larger weapons such as the main gun on a tank or smaller weapons such as hand held firearms carried by infantrymen. More specifically, the invention relates to projectiles which have an outer surface comprised of a plastic such as polytetrafluoroethylene, commonly referred to as teflon.

One of the advantages of a teflon coated projectile is the relatively low friction between the projectile and the gun barrel from which it is fired. Since the inner diametrical surface, or land, of a rifled gun barrel is smaller than the outer diameter of the projectile, friction between the projectile and the gun barrel is a significant factor in firing the gun. The low friction makes possible higher projectile speeds and reduces heat build up in the gun barrel during repeated firing of the gun. Consequently, the gun barrel has less tendency to sag or distort as a result of the gun being continuously fired. Additionally, a teflon coated projectile does not deposit lead or other metal from the projectile on the inner diameter of the barrel, thereby avoiding fouling of the gun. Such a projectile has been described in the U.S. Pat. No. 4,328,750 to Oberg et al.

My invention is a projectile having a metal or ceramic core surrounded by a plastic jacket, the invention having the same advantages as those referred to above for the teflon coated projectiles as well as other advantages. the jacket of my projectile is made from a flexible, resilient material such as teflon so that the jacket takes most or essentially all of the deformation of the projectile and barrel when the projectile is fired. The jacket of my projectile thus protects a lead or ceramic core from deformation or damage and reduces wear on the barrel. In addition, when my projectile leaves the barrel, the ridges on the projectile formed by the rifling grooves of the barrel either reduce in size or disappear altogether. The projectile consequently has a smoother, more aerodynamically efficient surface during flight and has a more accurately predictable flight path.

My design for a plastic jacketed projectile is relatively easy to manufacture. It is contemplated that the core can be cast or stamped by a relatively small press of, say, an eight ton capacity. The core can then have the plastic jacket injection molded around it preferably using a thermosetting resin, although a castable urethane plastic can also be used. The core of the projectile can be made of various weights, centers of gravity or shapes without changing the overall configuration of the projectile.

The flexibility of the plastic jacket permits my projectile to travel through a gun barrel with less driving force than a conventional projectile of similar size and weight. Consequently, less propellant is needed for a given round of ammunition and a smaller, lighter propellant compartment can be utilized so as to reduce the overall size and weight of the round. Therefore the round will not only be less expensive but the logistical cost of getting the round to soldiers in the field will be reduced. From a tactical standpoint, a soldier or military vehicle will be able to carry more rounds with my projectile than conventional rounds, whereby my projectile is advantageous in a battlefield scenario.

DESCRIPTION OF THE DRAWINGS

FIG. 11 shows fibers oriented parallel to the longitudinal axis of the projectile and FIG. 12 shows fibers oriented parallel to the rifling groove of the gun barrel in which the projectile is placed.

DETAILED DESCRIPTION

Figure 1:
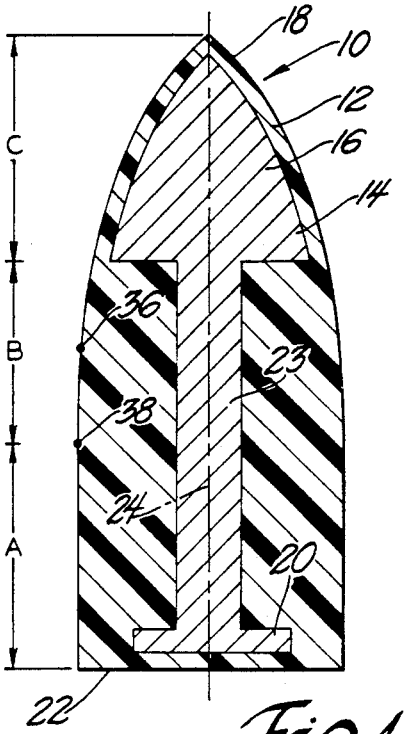
FIG. 1 is a cross sectional view of a first embodiment of my projectile, which has a full plastic jacket.

FIG. 1 shows a projectile 10 having a jacket 12 which is made from a low friction plastic material such as nylon, polyurethane or polytetrafluoroethylene and which has a smooth outer surface. Nylon, polyurethane and polytetrafluoroethylene are also examples of materials that have sufficient flexibility and elastic resilience for use in my projectile. As used here the term "elastic resilience" refers to the ability of a material to undergo deformation from compression, tension or sheer forces and return to its original shape once the forces are removed. In general terms, jacket 12 should be of a material having greater flexibility, elastic resilience, and lubricity than the material of the core, lubricity being the ability to slide easily along smooth surfaces such as those found on inner diameter of a steel gun barrel.

Within jacket 12 is a generally elongate core which can be made of a relatively soft metal such as lead or can be made of a relatively incompressible material such as a glass or a ceramic. Core 14 has a generally cone shaped head 16 at the forward end 18 of the projectile, a disk-shaped dumbbell 20 at rearward end 22 of the projectile and a round elongate shaft 23 connecting head 16 to dumbbell 20. A portion of jacket 12 is between dumbbell 20 and the rearward end 22 so that dumbbell 20, and thus core 14, are axially fixed within jacket 12. Jacket 12, shaft 23 and head 16 are radially symmetric with respect to longitudinal axis 24. Shaft 23 can be increased in diameter or dumbbell 20 can be made larger if it is desired to add weight to projectile 10. The size and shape of head 16 can likewise be changed to vary the weight of the projectile or to change the location of the projectile's center of gravity.

Figure 2:
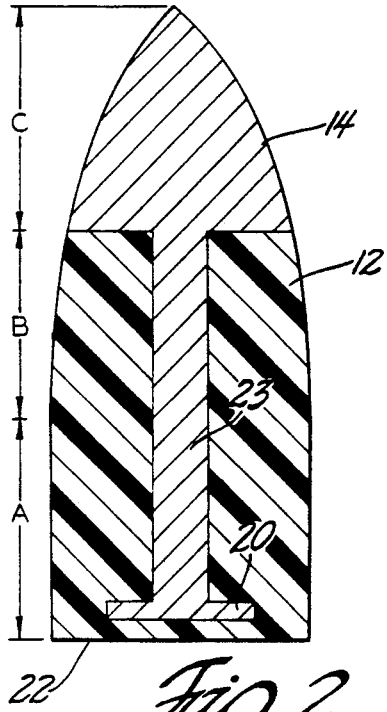
FIG. 2 is a second embodiment of my projectile, which has a half jacket of plastic.

For convenience of explanation, projectile 10 is divided into three axial zones labelled "A," "B" and "C", each zone having a preferred range of radial thickness for jacket 12. The surface of the projectile at zone "A" is parallel to axis 24 and will engage the rifling grooves of a gun barrel from which projectile 10 is to be fired, the rifling grooves typically having a radial depth of approximately five millimeters. It is preferred that the radial thickness of the jacket for guns with such typical rifling grooves be 10 to 20 millimeters. For other rifling groove depths, it is preferred that the jacket thickness in zone "A" be at least two to four times the groove depth. As shown in FIGS. 1 and 2, the outer peripheral surface of the projectile is smooth and unbroken along the projectile's entire axial length. As explained below, the surface's smoothness will be interrupted by the projectiles' engagement with the rifling grooves of a gun barrel.

Figure 4:
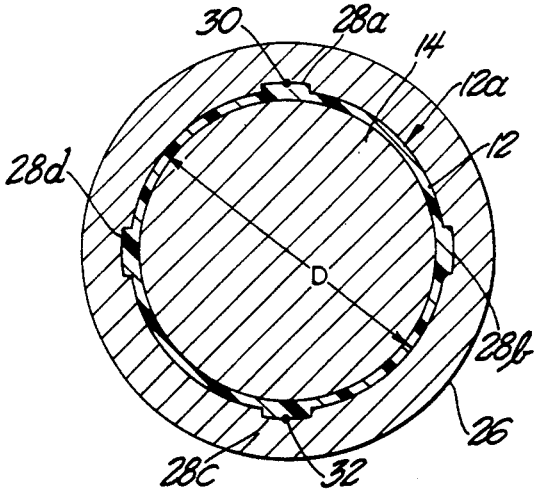
FIG. 4 is a cross-sectional view of an embodiment of my projectile wherein the core has a maximum desirable diameter and the jacket has a minimum desirable thickness, FIG. 4 further showing the engagement between the plastic jacket and the rifling grooves of a gun barrel.

The reason for the preferred thickness of jacket 12 is perhaps best explained with reference to FIG. 4, which is a cross-sectional view of Zone "A" of a projectile 12*a* in a gun barrel 26 having rifling grooves 28*a*, 28*b*, 28*c* and 28*d*. As is typical, gun barrel 26 has an inner diameter "D" smaller than the outer diameter of projectile 12*a*, the projectile's outer diameter being the same as the distance between points 30 and 32 on the beds of the rifling grooves in FIG. 4. Both projectile 12*a* and barrel 26 are deformed as the projectile passes through the barrel. The elasticity of the jacket allows the jacket to deform sufficiently to prevent permanent deformation of both core 14 and barrel 26. Additionally, in the FIG. 1 embodiment, essentially all of the elastic deformation during firing of projectile 10 will be imparted to jacket 12 and essentially none will occur to the barrel 26 or to core 14. Given that the outer diameter of projectile 12 is the bed-to-bed distance between opposing grooves, the depth of the grooves is the amount of radial compression that takes place. A jacket thickness of at least two to four times the groove depth is preferred to insure avoidance of permanent deformation to the gun barrel and the core of the projectile when the projectile is fired.

Returning now to FIG. 1, the thickness of jacket 12 at Zone "C" can be of any desired dimension from zero to the radius of the projectile relative to axis 24. In fact, FIG. 2 is an alternate embodiment of the projectile in FIG. 1, the alternate embodiment being a "half jacket" design wherein the thickness of the jacket in zone "C" is zero.

Zone "B" of the projectile is a zone where the diameter of projectile 10 gradually decreases from the maximum, zone "A" diameter to some diameter less than inner diameter "D" of gun barrel 26. At point 36, the diameter of projectile 10 is equal to the inner diameter of gun barrel 26 and no radial compression takes place. From point 36 to a point 38 at the border between zones "B" and "A", the inner diameter of barrel 26 partially compresses the projectile, the compression being increasingly greater for points further from point 36 and closer to point 38. In the portion of jacket 12 forward of point 38 and rearward of point 36, jacket 12 extends radially part of the way into rifling grooves 28*a–d*. The thickness of this portion of the jacket in its free state is preferably two to four times the radial distance by which jacket 12 extends into the grooves when projectile 12 is compressed inside barrel 26.

Figure 3:
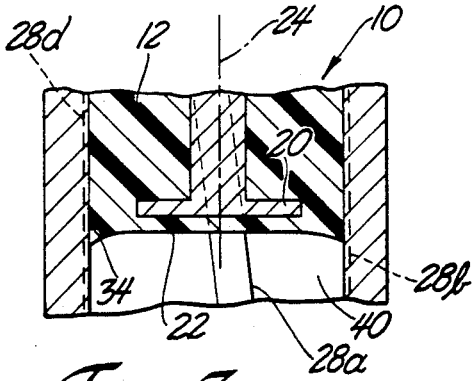
FIG. 3 is a partial cross-sectional view of my projectile showing the deformation of the rearward end of the projectile as it moves along a rifled gun barrel.

FIG. 3 shows a view of the rearward end 22 of projectile 10 as radially compressed in gun barrel 26. Jacket 12 has a generally annular rearward bulge 34 created by the radial compression on the jacket and the effect of friction dragging the surface of the jacket rearward with respect to the projectile, or downward in FIG. 3. The size of rearward bulge 34 is exaggerated in FIG. 3 for purposes of illustration and explanation. Dumbbell 20 extends radially outward from axis 24 for a distance of between one-third and two-thirds the outside diameter of the jacket. Since dumbbell 20 is smaller in diameter than head 16, compressed jacket material tends to be forced rearward through the gap between barrel 26 and the outer diameter of the dumbbell. This tends to increase the size of annular rearward bulge 34.

The rearward bulge is significant when a round of ammunition is fired through barrel 26. There will be pressure created in barrel area 40 by the explosion of propellant material behind projectile 12. The pressure from the explosion not only forces the projectile through the barrel, but the pressure also forces the rearward bulge against the inner peripheral surface of the gun barrel, thereby sealing the interface between the gun barrel and the projectile. This permits less compressive force to be used at zones "A" and "B" of the projectile in order to prevent pressure from the propellant's explosion from escaping forward past the projectile. It is believed that the seal effected by the annular rearward bulge therefore results in an overall reduction of friction between the projectile and the barrel as the projectile passes through the barrel. This in turn allows the use of less propellant material to effect the same projectile speed as would be the case with a conventional projectile. In the alternative, not reducing the amount of propellant material will cause my projectile to achieve greater velocity than a conventional projectile.

Figure 5:
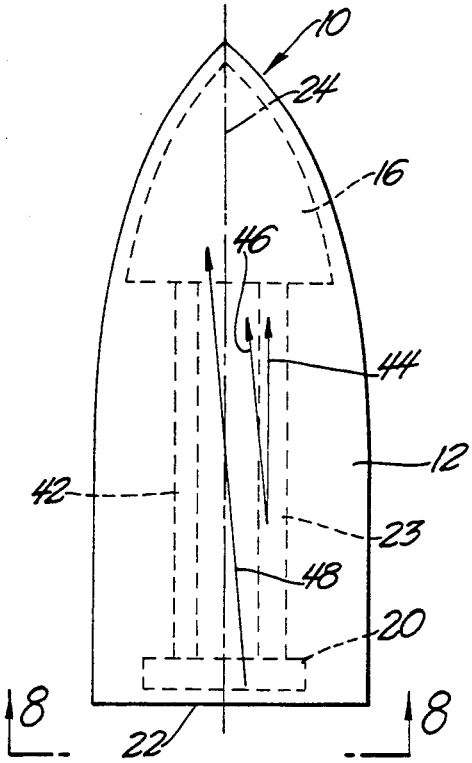
FIG. 5 is an elevational view of of a third embodiment of my projectile, FIG. 5 showing the directional alignment of rifling marks and jacket reinforcement fibers relative to the longitudinal axis of the projectile.
Figure 8:
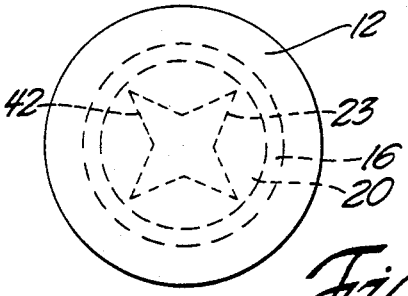
FIG. 8 is a view taken along line 8—8 in FIG. 5.

FIGS. 5 and 8 illustrate modifications that can be made to my projectile. FIG. 8 shows core 14 as having a star-like cross section at the shaft 23 of core 14 so that the shaft has radially outwardly tapering ridges as at 42. Such a shaft configuration prevents relative rotation between jacket 12 and shaft 23, and also gives longitudinal strength to projectile 10 so that the projectile will exhibit less longitudinal bending upon impact with a target.

FIG. 5 additionally includes directional arrows 44 and 46 which show two preferred orientations for reinforcing fibers (not shown) in jacket 12. These fibers are intended to increase the longitudinal strength of the projectile. If the fibers are oriented parallel to arrow 44, then maximum longitudinal strength enhancement occurs. If the fibers are made of material having good lubricating qualities such as graphite, then the ability of the outer surface to sheer off during projectile penetration into a sheet of armor is enhanced. The outer skin of the projectile can act as a lubricant to reduce friction between the projectile and the armored sheet so that the projectile has greater ability to penetrate the sheet.

Figure 10:
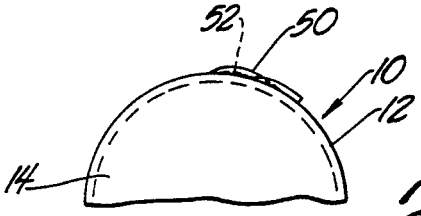
FIGS. 9 and 10 show views of ridges formed on the projectile by rifling grooves of a gun barrel.
Figure 9:
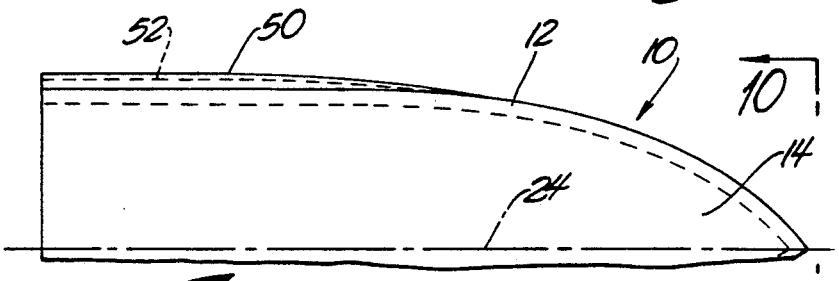

Also, the fibers may parallel arrow 46, which in turn parallels line 48 showing placement of a ridge on projectile 10. The ridge is formed by one of grooves 28*a–6* as the projectile is fired. For purposes of illustration, an exaggeratedly radially thick ridge is shown at 50 in FIGS. 9 and 10. Orientation of the fibers parallel to arrow 46 maximizes the degree to which jacket 12 can be radially compressed and still retain memory of its original shape. Thus, when projectile 10 leaves barrel 26 jacket 12 will tend to return to return to its original shape and the ridges 50 will reduce in size or disappear. The reduced ridges are illustrated at 52 in FIG. 9 and 10. The smaller or absent ridges will reduce aerodynamic friction as the projectile spins during its flight toward a target. As a further option, it may be desirable for some applications that the fibers not extend rearward beyond dumbbell 20. Absence of fibers rearward of dumbbell 20 will enhance the formation of rearward bulge 34 alluded to earlier.

Figure 11:
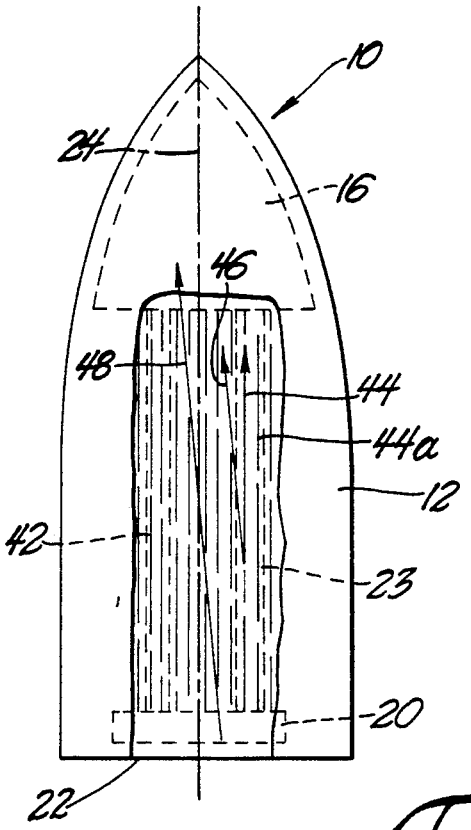
FIGS. 11 and 12 are partial cut-away views where a portion of the plastic jacket is removed to show fibers beneath the surface of the jacket.
Figure 12:
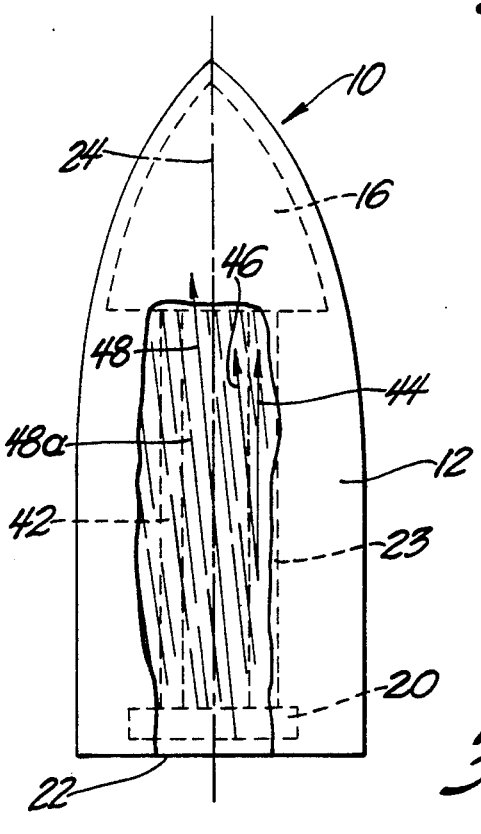

FIGS. 11 and 12 are partial cut-away views where a portion of plastic jacket 12 is removed to show fibers beneath the surface of the jacket. FIG. 11 shows fibers 44*a* oriented parallel to the longitudinal axis 24 of the projectile and FIG. 12 shows fibers 48*a* oriented parallel to directional arrow 48 and the rifling groove of the gun barrel in which the projectile is placed.

Figure 6:
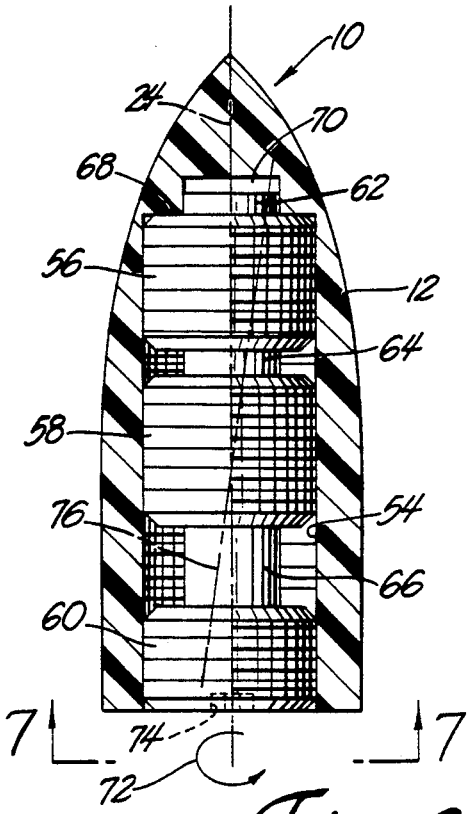
FIG. 6 is a fourth embodiment of my projectile, the fourth embodiment having threaded removable core members in the plastic jacket.
Figure 7:
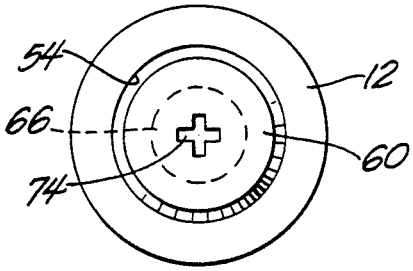
FIG. 7 is a view along line 7—7 in FIG. 6.

FIGS. 6 and 7 show still another embodiment of my projectile. In this embodiment, jacket 12 has internal threads 54 for engaging externally threaded core members 56, 58 and 60. Core member 56 has a relatively short stem 62, core member 58 has an intermediate length stem 64 and core member 60 has a relatively longer stem 66. The core members are in abutting contact and are individually removable from jacket 12 so that the cores can be arranged in any order along axis 24. A cross-shaped aperture such as that shown at 74 on core member 60 can be engaged by a screw driver in order to screw the core members into or out of jacket 12. It is possible to remove any one, or all of the core members if desired. It is, of course, possible to modify any of the core members by changing the length of the stem, the length of threaded portion of the core member, or length of both the stem and the threaded portion. For example, one may lengthen the stem of core member 60 so that it seats snugly in counterbore 70 or one could lengthen the threaded portion of core member 56 until it reached rearward end 22 of the projectile. The chief advantages of the FIG. 6 embodiment are the ability to adjust the weight of a projectile and to move the center of gravity of the projectile along axis 24 by using different orders and combinations of core members. Generally speaking, moving the center of gravity forward in a spining projectile causes the projectile to be more stable in flight and moving the center of gravity rearward tends to make the projectile tumble either in flight or upon striking a target. Both greater stability in flight and tumbling can be advantages, depending upon the target's distance and character. It is contemplated that the half jacket embodiment of my projectile shown in FIG. 6 could be modified to have removable core members such as core member 60, so that the FIG. 6 embodiment could have an adjustable weight and center of gravity.

Dashed line 76 in FIG. 6 represents the location and orientation of a rifling groove 26 relative to projectile 10. A rifling groove oriented and located as shown in FIG. 6 will spin jacket 12 in the direction of arrow 72, or clockwise as the jacket is seen in FIG. 7. When the projectile is fired the pressure from exploding propellant material acts on the rearward end of the projectile. The exposed rear surface area of core member 60 is greater than the exposed rear surface area of jacket 12 whereby greater axial forward force is exerted on core member 60 than on jacket 12. Due to the threading of core member 60, core member 60 is rotated counterclockwise in FIG. 7 relative to jacket 12, which tends to tighten core member 60 into the jacket. Thus core member 60 will not separate from jacket 12 during firing of projectile 12 despite the absence of an adhesive holding core member 60 to jacket 12.

I wish it to be understood that I do not desire to be limited to the exact details of construction shown and described herein since obvious modifications will occur to those skilled in the relevant arts without departing from the spirit and scope of the following claims.

I claim:

1. A projectile for a round of ammunition, the projectile capable of being driven through a barrel of a gun wherein the barrel has an inner diametric surface whose radius is smaller than the radius of a largest diameter zone of the projectile, wherein the inner diametrical surface of the barrel defines a generally spiral shaped groove, the groove having a bed surface radially outward of the inner diametrical surface, the projectile comprising:

a core radially symmetric about a longitudinal axis of the projectile;

a plastic jacket surrounding the core, the jacket having a rearward end and a forward end;

a portion of the jacket forming the largest diameter zone of the projectile, the largest diameter zone being deformed at least mainly elastically to form a groove engagement member when the largest diameter zone engages the inner diametrical surface of the barrel, the groove engagement member protruding radially outwardly relative to the axis at least part of the way into the groove;

wherein the plastic jacket has reinforcing fibers parallel to the axis of the projectile at a portion of the largest diameter zone that engages the inner diametrical surface.

2. The projectile of claim 1 wherein the core has radially extending ribs.

3. The projectile of claim 2 wherein the ribs taper in the radially outward direction.

4. The projectile of claim 1 wherein the core comprises:

a dumbbell at the rearward end embedded in the jacket;

a head at the forward end;

a shaft connecting the dumbbell to the head.

5. A projectile for a round of ammunition, the projectile capable of being driven through a barrel of a gun wherein the barrel has an inner diametric surface whose radius is smaller than the radius of a largest diameter zone of the projectile, wherein the inner diametrical surface of the barrel defines a generally spiral shaped groove, the groove having a bed surface radially outward of the inner diametrical surface, the projectile comprising:

a core radially symmetric about a longitudinal axis of the projectile;

a plastic jacket surrounding the core, the jacket having a rearward end and a forward end;

a portion of the jacket forming the largest diameter zone of the projectile, the largest diameter zone being deformed at least mainly elastically to form a groove engagement member when the largest diameter zone engages the inner diametrical surface of the barrel, the groove engagement member protruding radially outwardly relative to the axis at least part of the way into the groove;

wherein the plastic jacket has reinforcing fibers oriented parallel to the groove at a portion of the largest diameter zone that engages the inner diametrical surface.

6. A projectile for a round of ammunition, the projectile capable of being driven through a barrel of a gun wherein the barrel has an inner diametric surface whose radius is smaller than the radius of a largest diameter zone of the projectile, wherein the inner diametrical surface of the barrel defines a generally spiral shaped groove, the groove having a bed surface radially outward of the inner diametrical surface, the projectile comprising:

a core radially symmetric about a longitudinal axis of the projectile;

a plastic jacket surrounding the core, the jacket having a rearward end and a tapered forward end;

a portion of the jacket forming the largest diameter zone of the projectile, the largest diameter zone being deformed at least mainly elastically to form a groove engagement member when the largest diameter zone engages the inner diametrical surface of the barrel;

means for longitudinally strengthening the projectile, the strengthening means including fibers in the jacket oriented in one of the following directions, parallel to the longitudinal axis of the projectile and parallel to the groove;

wherein the jacket has an annular reardwardmost zone free of the fibers.

7. The projectile of claim 6 wherein the fibers are oriented parallel to the longitudinal axis of the projectile.

8. The projectile of claim 6 wherein the fibers are parallel to the groove.

9. The projectile of claim 6 wherein the fibers are made of a lubricative material, whereby an outer layer of the jacket sheers off as the projectile penetrates a target.

10. The projectile of claim 9 wherein the fibers are made of graphite.

* * * * *